US006939460B2

(12) United States Patent
Erlich

(10) Patent No.: US 6,939,460 B2
(45) **Date of Patent: *Sep. 6, 2005**

(54) PORTABLE ELECTRIC POOL CLEANER

(75) Inventor: Guy Erlich, New York, NY (US)

(73) Assignee: Water Tech LLC., East Brunswick, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/948,031

(22) Filed: Sep. 23, 2004

(65) Prior Publication Data

US 2005/0035039 A1 Feb. 17, 2005

Related U.S. Application Data

(63) Continuation of application No. 10/282,883, filed on Oct. 29, 2002, now Pat. No. 6,797,157.

(51) Int. Cl.[7] ..... E04H 4/16

(52) U.S. Cl. ..... 210/94; 210/136; 210/169; 210/238; 210/416.2; 15/1.7; 134/168 R

(58) Field of Search ..... 210/94, 136, 169, 210/238, 416.1, 416.2, 232; 15/1.7; 4/490, 496; 134/168 R

(56) References Cited

U.S. PATENT DOCUMENTS

| | | | | | |
|---|---|---|---|---|---|
| 3,755,843 | A | | 9/1973 | Goertzen, III et al. | 15/1.7 |
| 3,886,616 | A | * | 6/1975 | Hayes | 15/1.7 |
| 4,443,899 | A | * | 4/1984 | Johnson | 4/490 |
| 4,651,376 | A | | 3/1987 | Ford | 15/1.7 |
| 4,801,376 | A | * | 1/1989 | Kulitz | 210/123 |
| 4,935,980 | A | * | 6/1990 | Leginus et al. | 15/1.7 |
| 4,962,559 | A | | 10/1990 | Schuman | 15/1.7 |
| 5,111,129 | A | | 5/1992 | Schuman | 320/2 |
| 5,135,647 | A | | 8/1992 | Childers | 210/136 |
| 5,137,623 | A | * | 8/1992 | Wall et al. | 210/169 |
| 5,450,644 | A | | 9/1995 | Berman | 15/1.7 |
| 5,554,277 | A | * | 9/1996 | Rief et al. | 210/94 |
| 5,569,371 | A | * | 10/1996 | Perling | 210/85 |
| 5,842,243 | A | | 12/1998 | Horvath et al. | 15/1.7 |
| 5,951,854 | A | * | 9/1999 | Goldberg et al. | 210/85 |
| 6,248,232 | B1 | | 6/2001 | Stoner | 210/136 |
| 6,294,084 | B1 | | 9/2001 | Henkin et al. | 210/143 |
| 2001/0004974 | A1 | | 6/2001 | Ekenback et al. | 210/143 |
| 2001/0032809 | A1 | | 10/2001 | Henkin et al. | 210/143 |
| 2001/0050093 | A1 | | 12/2001 | Porat | 134/8 |
| 2002/0002750 | A1 | | 1/2002 | Phillipson et al. | 15/1.7 |

OTHER PUBLICATIONS

Copy of Form PTO–1449 in U.S. Appl. No. 10/282,883 checked on Dec. 15, 2003, listing the art identically listed above.

Copy of Form PTO–892 in U.S. Appl. No. 10/282,883, listing art cited and identically listed above.

* cited by examiner

*Primary Examiner*—Fred G. Prince
(74) *Attorney, Agent, or Firm*—Abelman, Frayne & Schwab

(57) ABSTRACT

A hand-held, electrically-powered pool cleaner includes a body and a nozzle for suctioning pool water. The body has a filter, an impeller and motor, rechargeable batteries, and a handle for carrying the body and for maneuvering the nozzle along a surface being cleaned the surface. The impeller draws pool water through the nozzle and the filter to remove debris water. A filter housing disposed between the nozzle and the body accumulates the filtered debris. The body optionally includes a pole attachment member to receive the free end of a pole for maneuvering the cleaner from outside of the pool.

20 Claims, 12 Drawing Sheets

PORTABLE ELECTRIC POOL CLEANER

CROSS-REFERENCE TO RELATED APPLICATIONS

This is a continuation of U.S. application Ser. No. 10/282,883, filed Oct. 29, 1002, now U.S. Pat. No. 6,797,157, issued Sep. 28, 2004.

FIELD OF THE INVENTION

This invention relates to an electrical pool cleaning apparatus, and in particular to a hand-held pool cleaner.

BACKGROUND OF THE INVENTION

Pool cleaning apparatus are known for passing over the surfaces of pools to remove dirt and debris and filter the pool water. Such pool cleaning apparatus are typically bulky. A lightweight and hand-held pool cleaner would be advantageous to allow a user to easily manipulate the pool cleaner over the surfaces of a pool, spa or pond.

Known pool cleaning apparatus require power cords extending through the water to outside electrical outlets. A portable pool cleaner powered by batteries would be advantageous to eliminate the need for power cords.

In battery-powered devices capable of being used underwater, the ability to recharge the batteries with an externally disposed charging port is necessary. Although the device being used underwater is not being charged, such externally disposed charging ports can be exposed to the water, risking a short in the device and so potentially damaging the device. A water-tight charging port would be advantageous for battery-powered devices that are immersed in water, such as pool cleaning apparatus.

BRIEF SUMMARY OF THE INVENTION

A highly portable, hand-held pool cleaner is powered by rechargeable batteries, and includes body and intake nozzle for suctioning pool water. The body houses a filter, an impeller attached to an electric motor, and includes a handle for carrying the body, arid for manipulating the nozzle over a surface of a pool to clean the surface. The impeller suctions pool water through the nozzle and the filter retains dirt and debris removed from the pool water. A filter housing disposed between the nozzle and the body accumulates the filtered debris. A pole attachment member, mounted to the body, releasably receive's the free end of a pole in secure attachment for manipulating the cleaner from a remote location adjacent the surface of the pool to that is to be cleaned.

BRIEF DESCRIPTION OF THE SEVERAL VIEWS OF THE DRAWINGS

Preferred embodiments of the invention are described hereinbelow with reference to the drawings wherein.

DETAILED DESCRIPTION OF THE INVENTION

Figure 1:
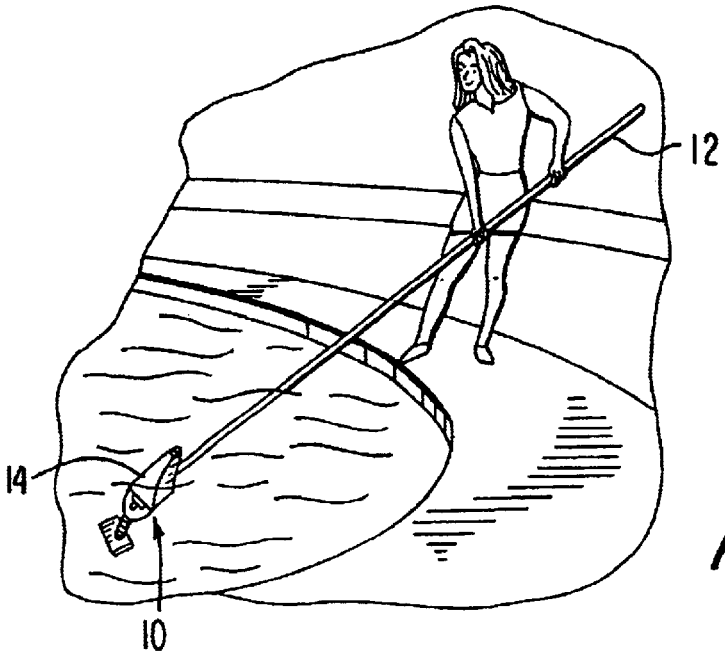
FIG. 1 illustrate's one mode of operating a pool cleaner in operation in accordance with one embodiment of the present invention.

As described herein, FIG. 1 illustrates a pool cleaner 10 in accordance with the present invention in one mode of operation. The pool cleaner 10 is battery-powered, and capable of suctioning particulate material as well as debris of a relatively large size, such as leaves, from the surfaces to be cleaned. The pool cleaner 10 includes a filter for filtering the sectioned material and one or a plurality of discharge ports for expelling the filtered water.

In a first mode of operation shown in FIG. 1, the pool cleaner 10 is attachable to a pole 12, allowing the user to clean the pool surfaces while standing outside the pool. In a second, hand-held mode of operation, the pool cleaner 10 includes an integral handle 14, allowing the user immersed with the pool cleaner 10 in the pool to grasp and orient the pool cleaner 10 and so to manipulate the pool cleaner 10 over the surfaces.

As shown in the side elevational view of the pool cleaner 10 includes a body 16 with projecting handle 14. The body 16 can be composed of molded plastic with an egonometric streamlined shape, e.g., a smooth and curvilinear surface providing low resistance in the water. The handle is preferably integrally formed from the molded plastic to allow the pool cleaner 10 to be hand-held and to be easily carried and manipulated. The body 16 includes hollow sections 18, shown in FIGS. 8–11, which fill with water during immersion, so the pool cleaner 10 is not buoyant after fall immersion. The pool cleaner 10 configured to be of essentially neutral buoyancy so that it be manipulated underwater with relative ease in any orientation along any horizontal vertical or curved surfaces that is being cleaned.

A pole attachment member 20 extends from the, body 16, allowing the extended pole 12 to be securely, but removably attached to the pool cleaner 10 for use in the first mode of operation shown in FIG. 1. The pole 12 can be attached to the pole attachment member 20 by any known fastening devices, such as removable screws with corresponding apertures. Alternatively, the pool attachment member 20 can include spring-loaded buttons and detents 22, such as shown in FIG. 2, or other curved surfaces for removably attaching the pole 12 in a friction fit.

A plurality of discharge water discharge ports or apertures 24 are present in the body 16, allowing filtered water to be returned to the pool, and for allowing water to flow into and out of the hollow portions. In a preferred embodiment illustrated in FIG. 2, the water discharge ports 24 are symmetrically oriented to expel the filtered water in a direction generally perpendicular to the longitudinal axis 56 of the pole attachment member 20, preventing water jet pressure of the expelled water exiting from any single water expulsion port 24 from causing the pool cleaner 10 to move in an unintended direction. Accordingly, the pool cleaner 10 is easy to manipulate-when in use, and responds primarily to the movement determined by the user by use of the handle 14 or the pole 12 when attached to the pole attachment member 20.

A filter housing 26 is mounted to the fore of the body 16 for accumulating the debris sectioned into the pool cleaner 10. In a preferred embodiment, the filter housing 26 is composed of transparent plastic, allowing the user to see the amount of debris sectioned and the remaining capacity of the filter housing 26 and thereby to determine the need for emptying the accumulated debris.

Figure 2:
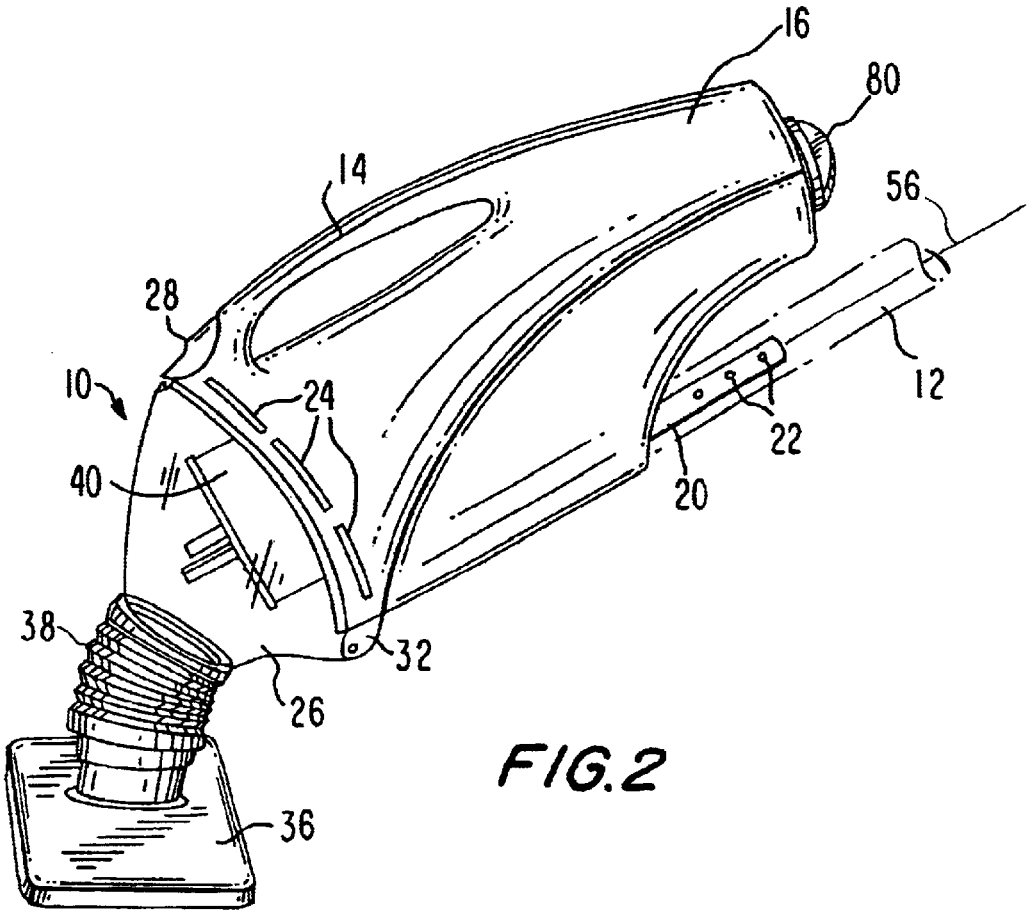
FIG. 2 is a side elevational view of the pool cleaner illustrated in FIG. 1.
Figure 3:
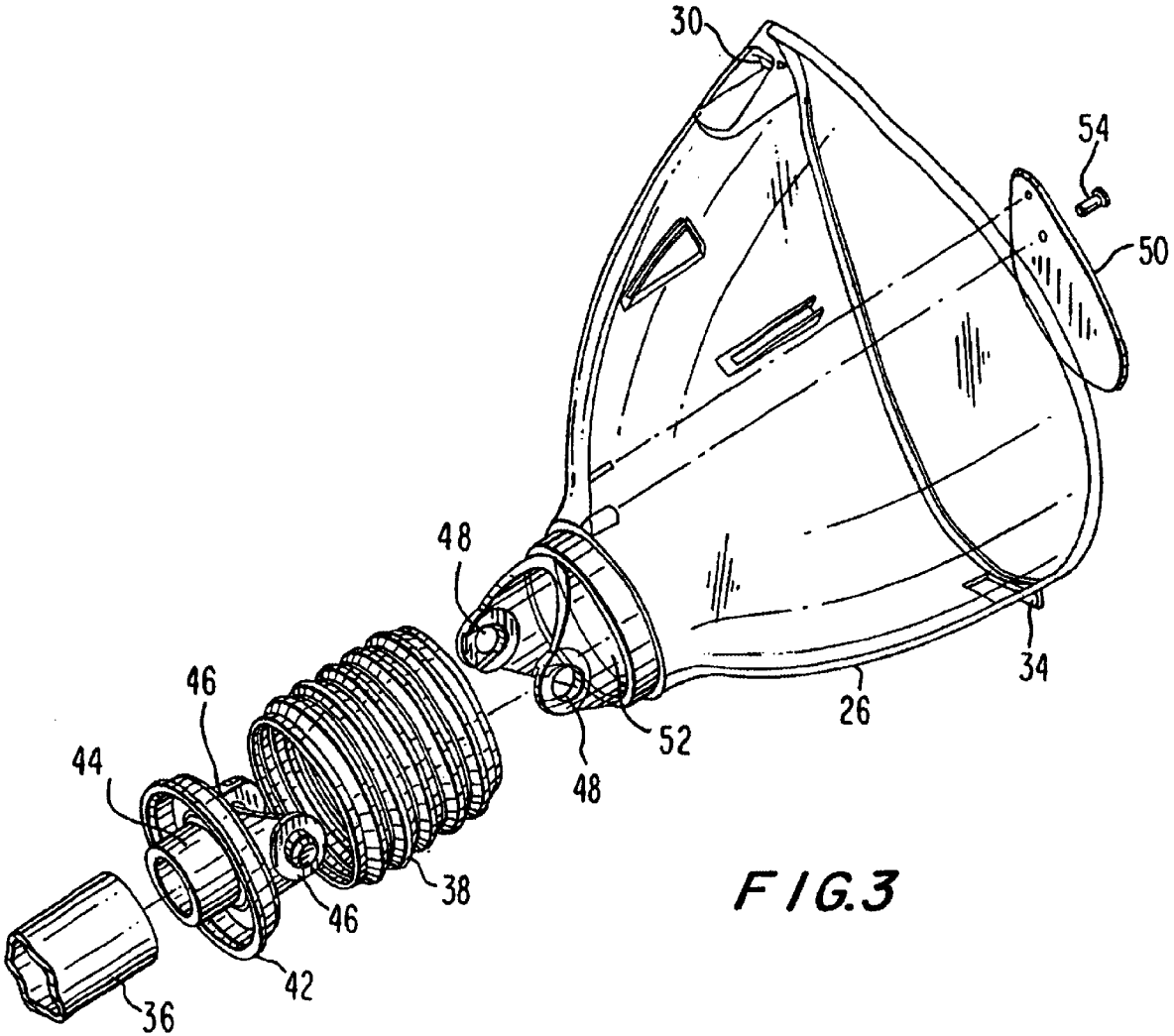
FIG. 3 is a side perspective view of a nozzle end of the pool cleaner with parts separated.

As also shown in FIG. 2., the filter housing 26 is attached to the body 16 by a latch-and-hinge-arrangement. A releasable latch 28 fits into a latch aperture 30, as best shown in FIG. 3, allowing the filter housing 26 to pivot away from the body 16 about a hinge 32 to permit emptying of debris from the filter housing 26. In one embodiment, the hinge 32 permanently affixes the filter housing 26 to the body 16 in a pivoting configuration. In another embodiment, the hinge can be a removable hinge, engaging a complementary hinge member 34 on the filter housing 26, shown in FIG. 3, in which the filter housing 26 is capable of being detached from the hinge 32 after being pivoted to a predetermined angle.

During operation of an internally disposed impeller mechanism, described below, pool water containing debris is sectioned through the nozzle attachment 36 and the ribbed or bellows cover 38 forms a conduit positioned at the fore of the filter housing 26 and forms a watertight seal at its points of attachment to the nozzle and housing. The cover 38 can be formed of molded polymeric material, and optionally provided with wire reinforcement. The impelled water passes through a filter 40 in the filter housing 26, the filtered water then passes through and out of the water discharge ports 24.

As shown in FIG. 3, the nozzle end of the pool cleaner 10 includes a nozzle pivot interface 42 and the cover 38 disposed between the filter housing 26 and the nozzle attachment 36. The nozzle pivot interface 42 includes a tubular member 44 to which a particular selected nozzle attachment 36 is removably secured, for example, by a friction fit or by means of locking lugs. In one embodiment, the nozzle pivot interface 42 has a predetermined width for the attachment to standard, commercially available nozzle attachments such as components with widths of about one inch (about 2.5 cm). The nozzle pivot interface 42 includes protruding circular pegs 46 for receiving circular apertures 48 at the fore end of the filter housing 26.

The flexible bellows 38 is disposed between the nozzle pivot interface 42 and the filter housing 26, allowing the nozzle pivot interface 42 and the nozzle attachment 36 mounted thereto to pivot about the circular pegs 46, and so permitting the pool cleaner 10 to be easily manipulated over and around curved surfaces in the pool.

A check or flap valve 50 composed of flexible material can be mounted at the entry port 52 of the filter housing 26 using known fastening devices, such as a rivet 54. The suctioning water jet pressure from the impeller mechanism opens the flap valve 50, and cessation of the water jet force by turning off the pool cleaner 10 closes the flap valve 50 to prevent the entrained debris from flowing out of the filter housing 26 and back through the nozzle.

Referring again to FIG. 2, in a preferred embodiment, the longitudinal axis 56 of the pole attachment member 20 is aligned to pass through the nozzle pivot interface 42, for example, at the position of the circular pegs 46. Such alignment directs the forces imparted from the user to be directed toward the nozzle pivot interface 42 and the nozzle attachment 36 mounted thereto, to provide greater control of the movement of the nozzle end of the pool cleaner 10 over the pool surfaces and towards debris to be sectioned.

Figure 4:
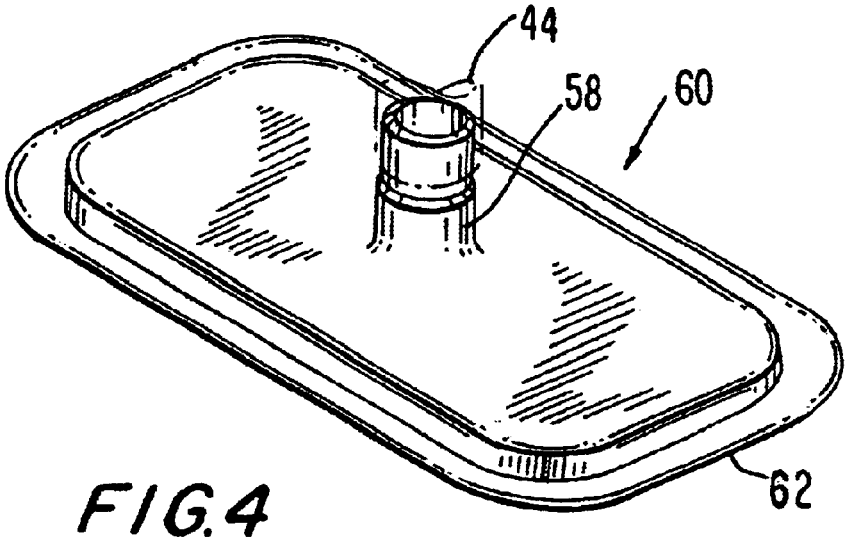
FIG. 4 is a top perspective view of one embodiment of a nozzle attachment.
Figure 5:
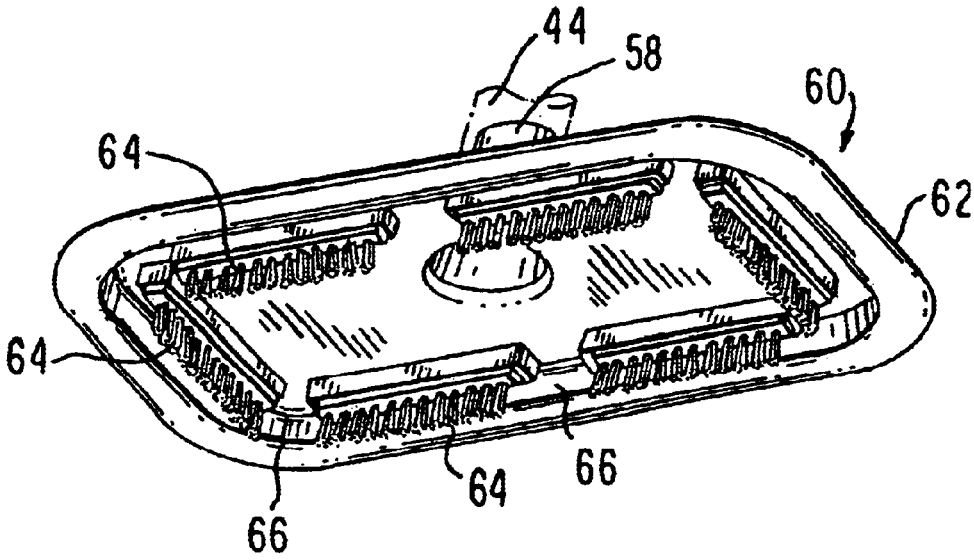
FIG. 5 is an underside perspective view of the nozzle attachment of FIG. 4.
Figure 6:
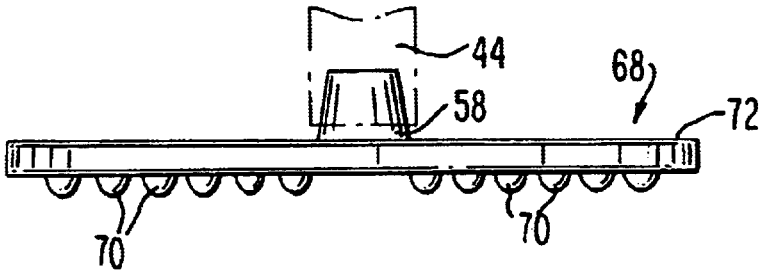
FIG. 6 is a side elevational view of an alternative embodiment of a nozzle attachment.

The nozzle attachments 36 described herein include a tubular member 58 removably attachable to the nozzle pivot interface 42, as shown in FIGS. 4–6. The nozzle attachments 36 can optionally include other features. For example, the nozzle attachments 36 can be identical to, or adapted from known nozzle attachments for use with vacuum cleaners. Alternatively, the nozzle attachment 36 can be custom-designed for use in cleaning pools, spas, ornamental outdoor ponds and the like.

As shown in FIGS. 4–5, a custom-designed pool cleaner 60 can include a tubular member 58 and a base 62 having a plurality of spaced brushes 64. The brushes 64 dislodge dirt and debris from the pool surface, allowing the pool cleaner 10 to suction up the dislodged debris. By spacing the brushes 64 to having predetermined gaps 66 therebetween, the velocity of the suctioning water is increased through the gaps 66 to increase the effectiveness of the intake of debris.

In an alternative embodiment shown in FIG. 6, the nozzle attachment 68 can include protrusions 70 on a base 72, to prevent the suctioning effect of the pool cleaner 10 from causing the base 72 to be flush with the pool surfaces, and so impeding movement of the pool cleaner 10.

Figure 7:
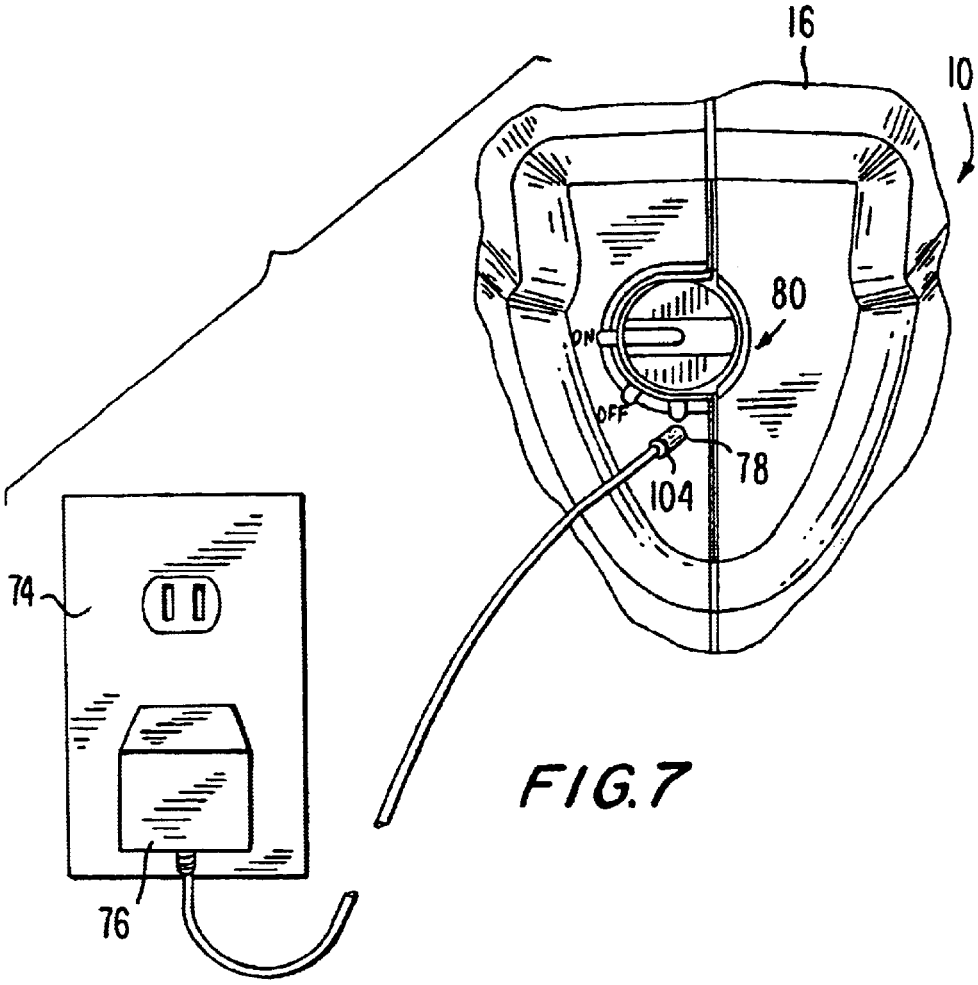
FIG. 7 is a partial rear elevation view-of the pool cleaner in a charging mode with an electrical outlet.

In use, the pool cleaner 10 is adapted to operate for long periods of time using batteries, and preferably rechargeable batteries, for operating a motor and pump or water impeller mechanism. Referring now to FIG. 7, the pool cleaner 10 is shown in a charging configuration with an electrical outlet 74, in which an electrical interface 76, such as an AC/DC converter, plugs into the electrical outlet 74, and also plugs into a charging port 78 in the rear of the pool cleaner 10. The pool cleaner 10 can be controlled using an operating switch 80 which can be moved between ON and OFF positions. In a preferred embodiment, the operating switch 80 also includes a CHARGING position in which the pool cleaner 10 is off, preventing the pool cleaner 10 from being activated in the water while plugged into an electrical outlet 74, to thereby avoid dangerous electrocution conditions.

Figure 8:
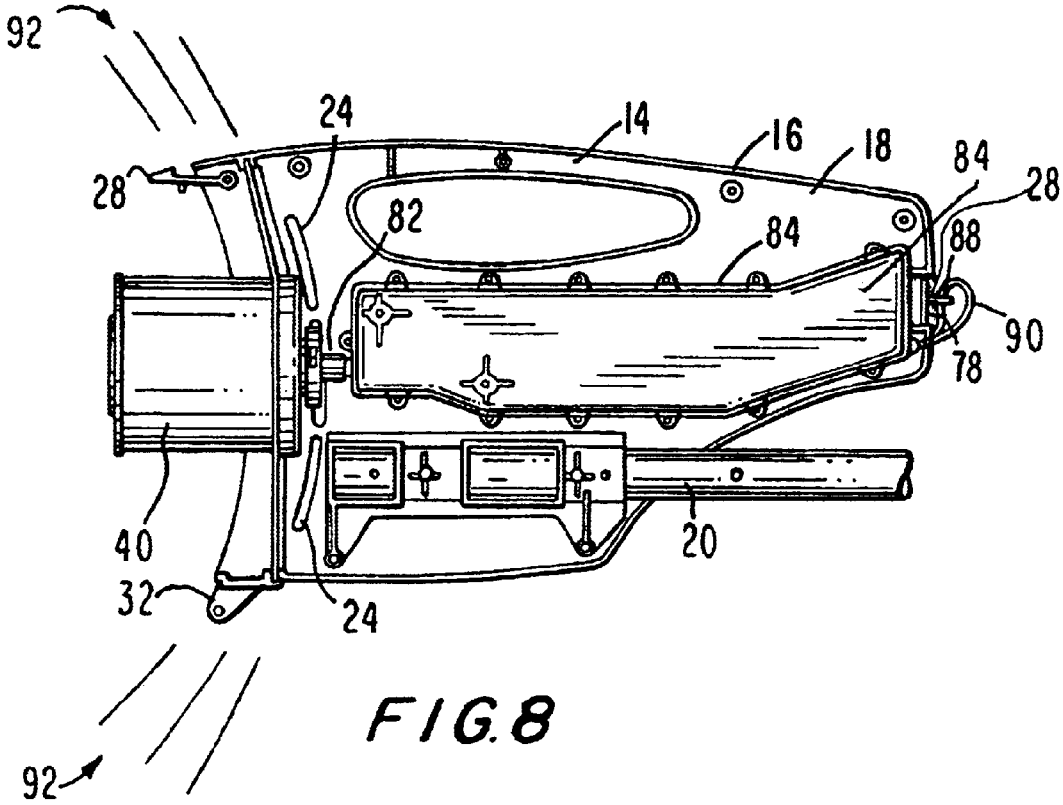
FIG. 8 is a first side cross-sectional view of the body of the pool cleaner of FIG. 2.
Figure 9:
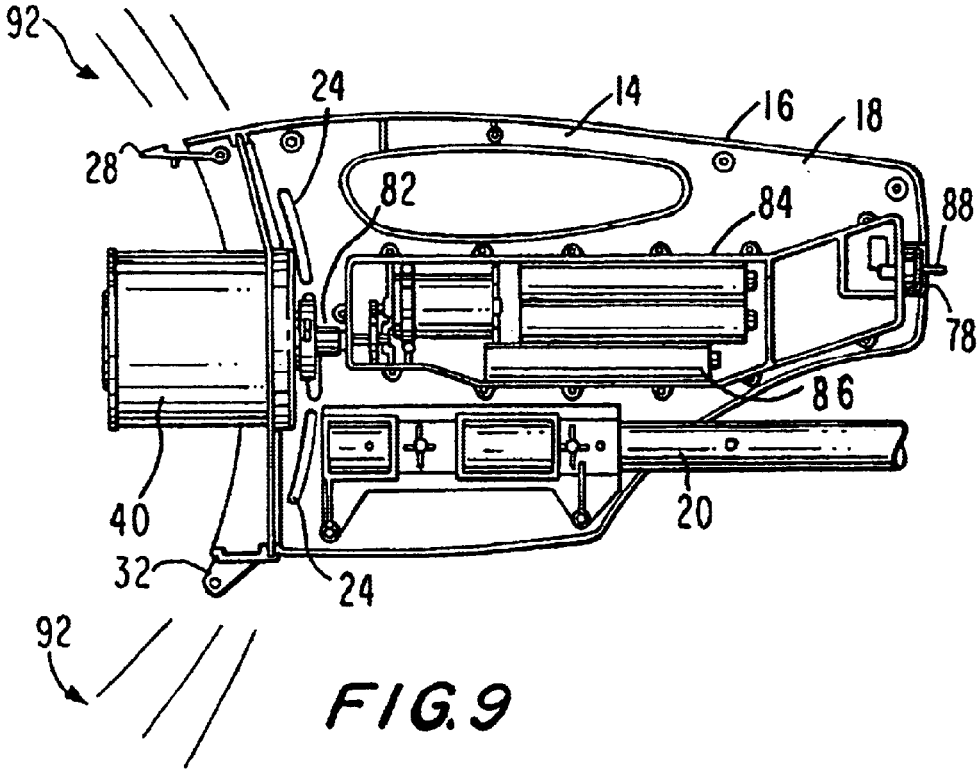
FIG. 9 is a second side cross-section view of the body of the pool cleaner of FIG. 2.
Figure 10:
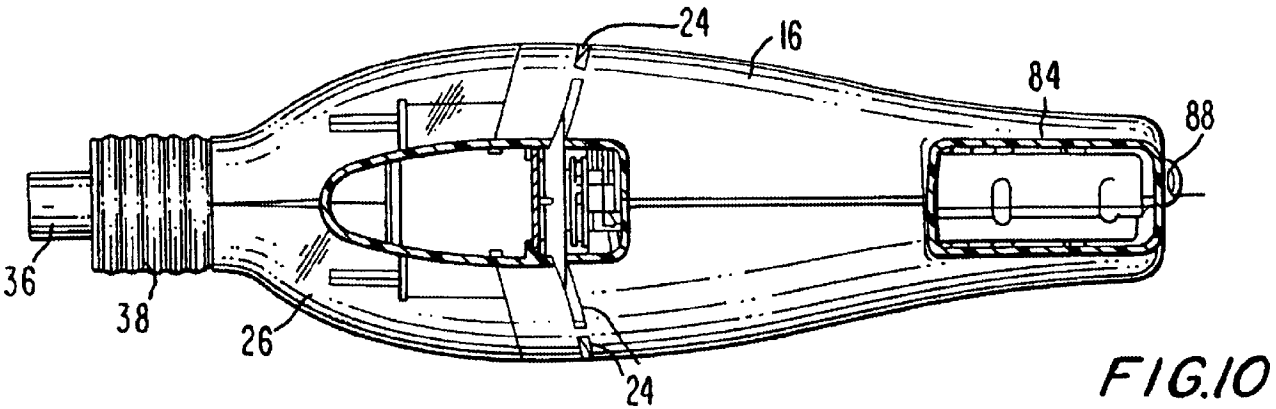
FIG. 10 is a top cross-sectional view of the pool cleaner of FIG. 2.

Referring now to FIGS. 8–10, the pool cleaner 10 is shown in cross-sectional views, illustrating the impeller mechanism 82 disposed behind the filter 40 and electrically connected to the battery pack 84 having at least one battery 86. The battery pack 84 is electrically connected to the charging port 78. The impeller mechanism 82 is any known type of device for causing a suctioning movement of water through the filter 40 and out through the water expulsion ports 24. The battery pack 84 is disposed in an air-tight section within the body 16 which extends to the charging port 78. In one embodiment, the charging port 78 can include a removable cap 88 which is loosely attached to the body 16 by a wire 90 or other fastening device, such that the removable cap 88 cannot be lost or separated from the pool cleaner 10.

As shown in FIG. 8–9, the impeller mechanism 82 causes the filtered water to be expelled in multiple water streams 92 having a symmetry to avoid hydraulic forces that could induce lateral movement of the pool cleaner 10 in any single direction.

Figure 11:
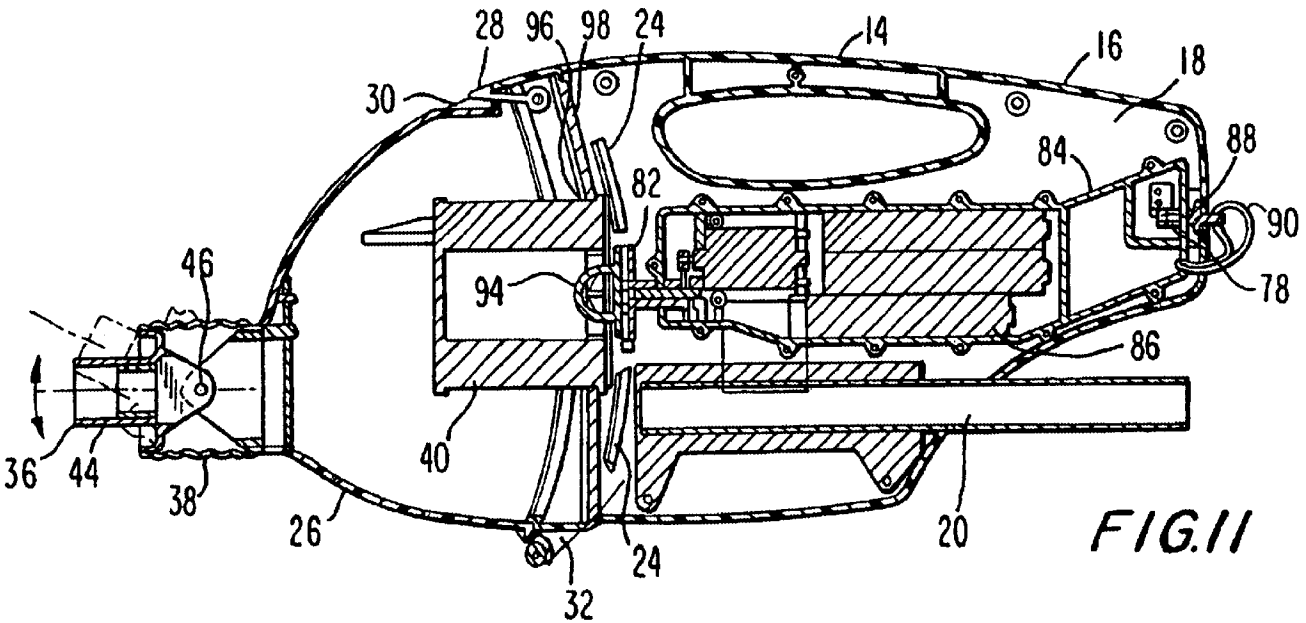
FIG. 11 is a side cross-sectional view of the pool cleaner of FIG. 2.
Figure 12:
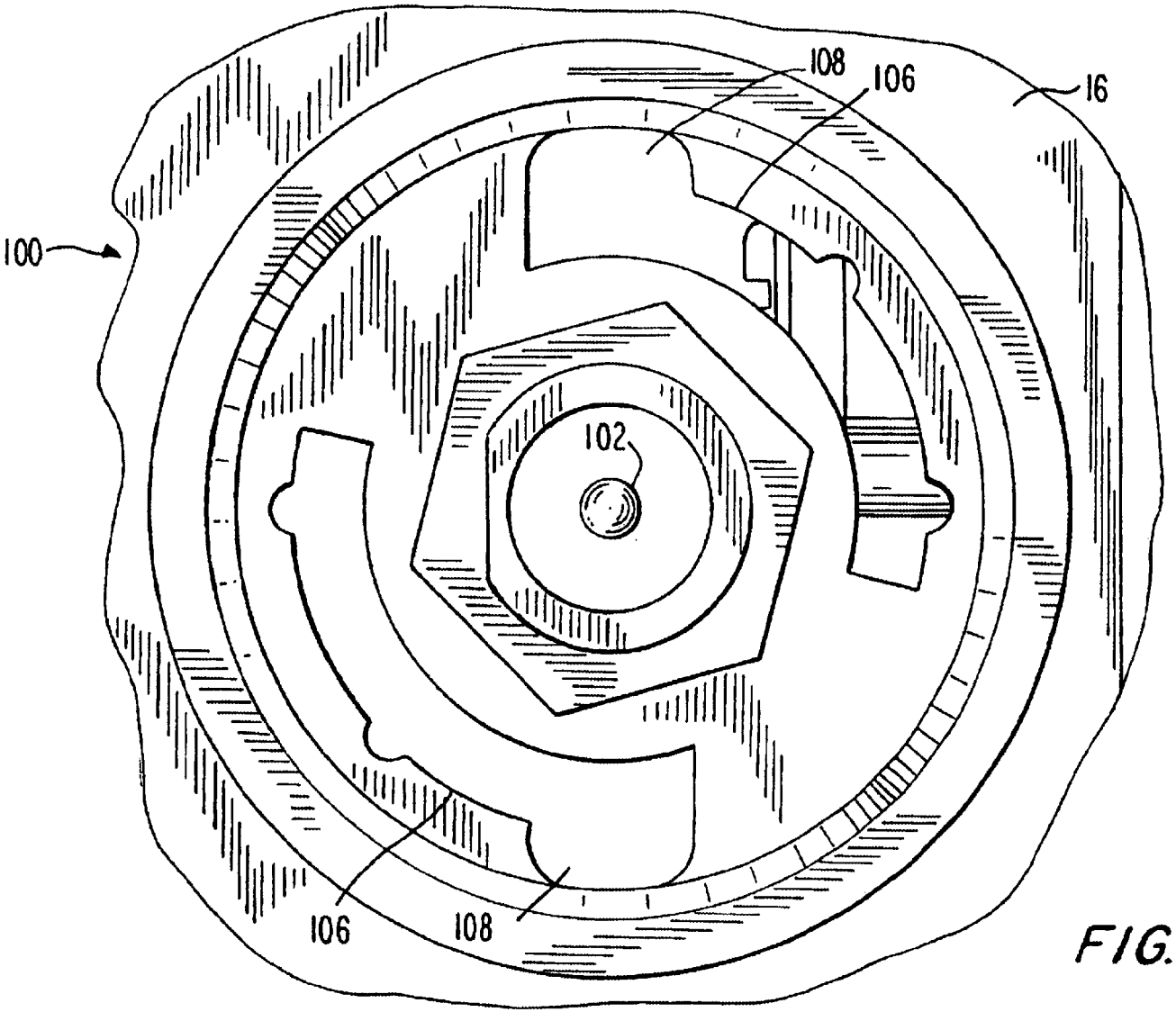
FIG. 12 is a front elevational view of a charging input port.

Referring to FIGS. 10–11, the filter housing 26 is shown in a removably mounted configuration on the body 16 of the pool cleaner 10, using the latch-and-hinge mechanism described herein, with the filter 40 disposed therein to filter the sectioned water passing through the pivotable nozzle end. The filter 40 is removably mounted to the body 16 in front of a plunger member 94 of the impeller mechanism, for example, by a friction fit of ends of the filter 40 to a filter aperture 96 in a front inner surface 98 of the body 16. The filter 40 is-received in filter housing 26 and can be any known type of filter or mesh for straining particulate matter of a predetermined minimum size.

Figure 13:
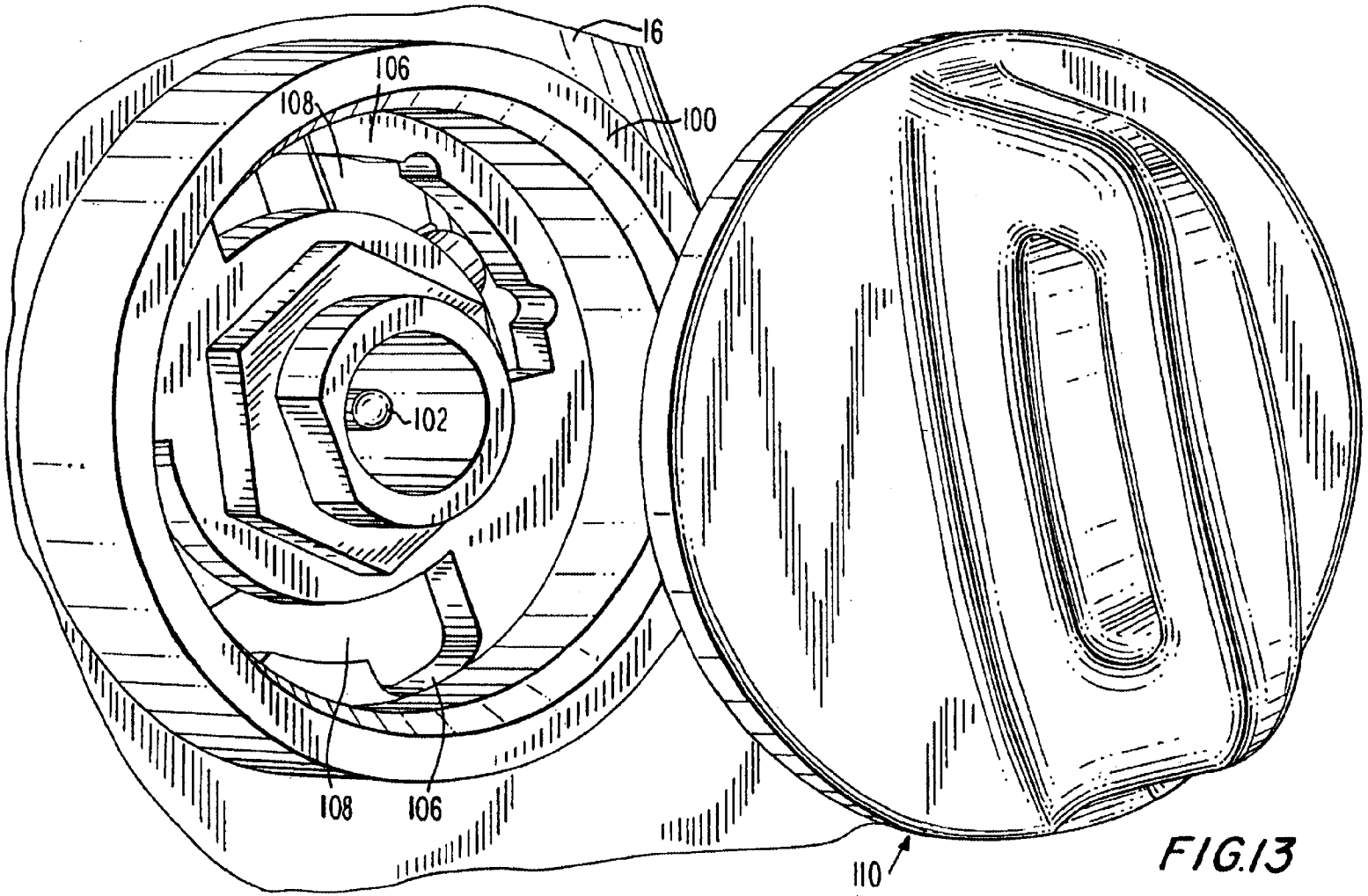
FIG. 13 is a front side perspective view of the charging input port of FIG. 12 with a protective cover unattached.
Figure 14:
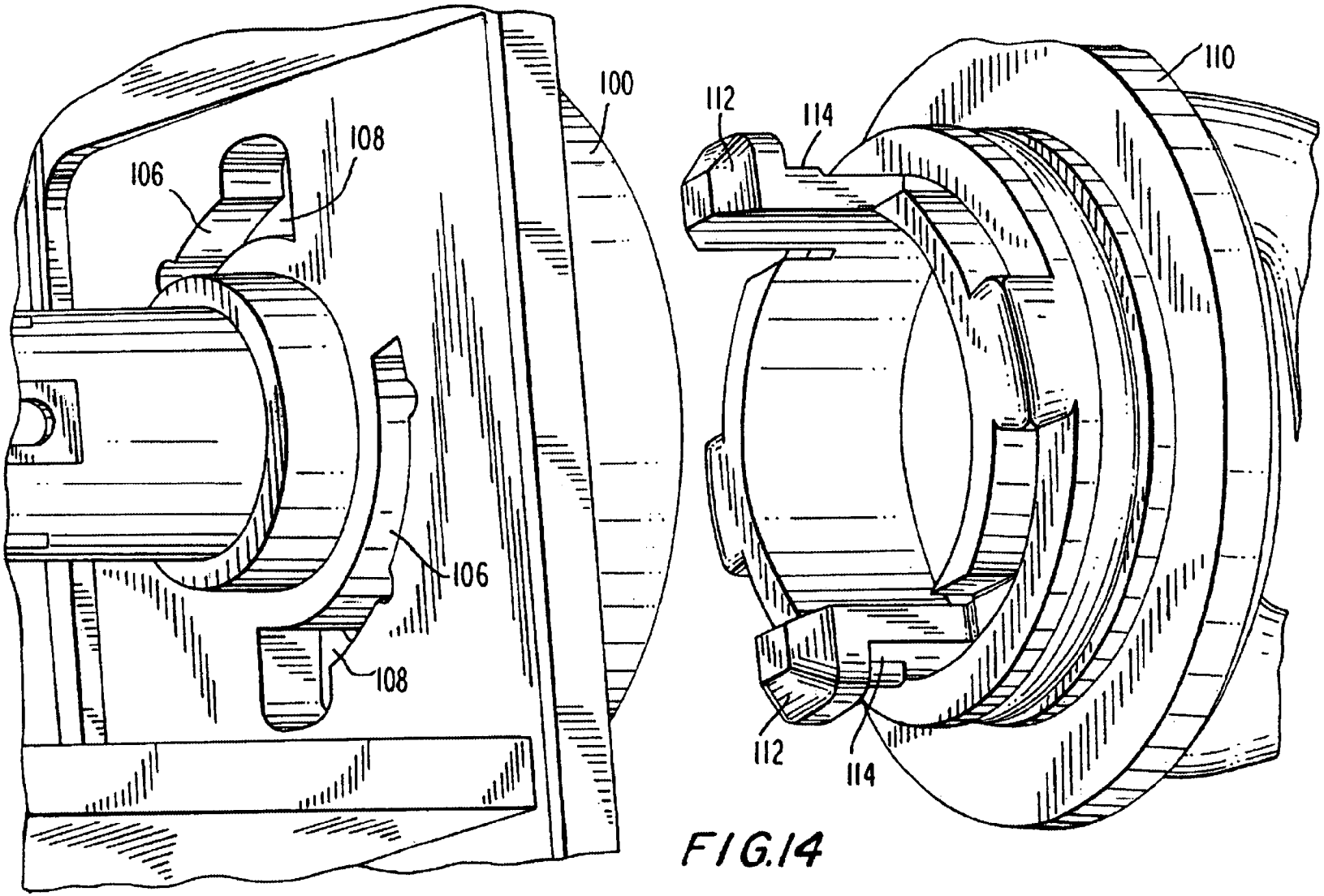
FIG. 14 is a rear side perspective view of the charging input port of FIG. 12 with a protective cover unattached.

In an alternative embodiment of the charging input port, shown in FIGS. 12–17, the charging input port 100 has a central metallic contact 102 for engaging a conductive contact of the plug 164 of the converter shown in FIG. 7. As shown in FIG. 13, a plurality of surfaces 106 and apertures 108 are provided on the body 16 of the pool cleaner 10, disposed on the sides of the central metallic contact 102. As shown in FIG. 14, a protective cover 110 includes armatures 112 for fitting into the apertures 108, and also includes a plurality of complimentarily surfaces 114 for engaging and frictionally securing the protective cover 110 against the surfaces 106 on the body 16 to provide a water-tight covering of the charging input port 100.

Figure 15:
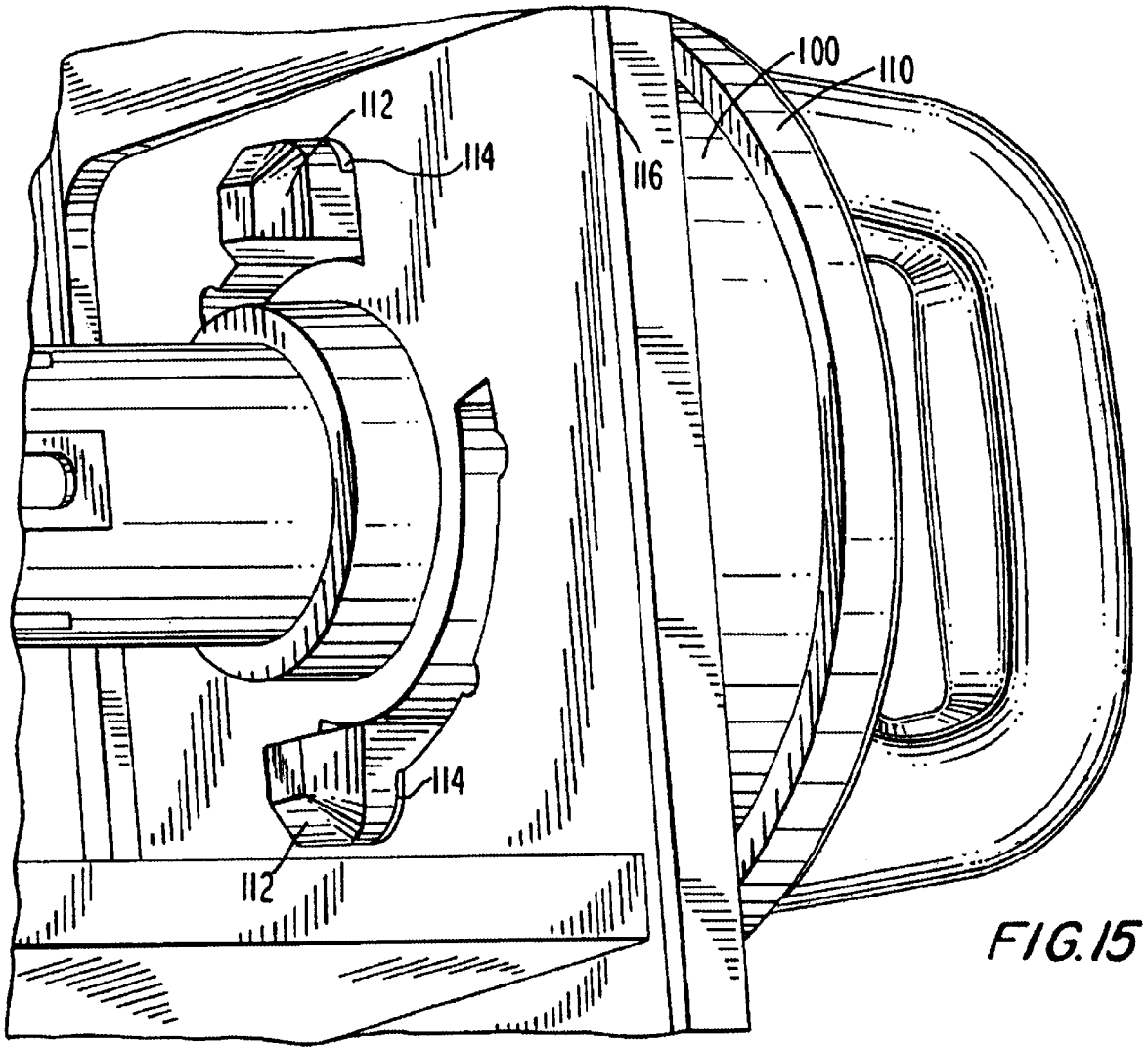
FIG. 15 is a rear side perspective view of the charging input port of FIG. 12 with a protective cover attached in a first position.
Figure 16:
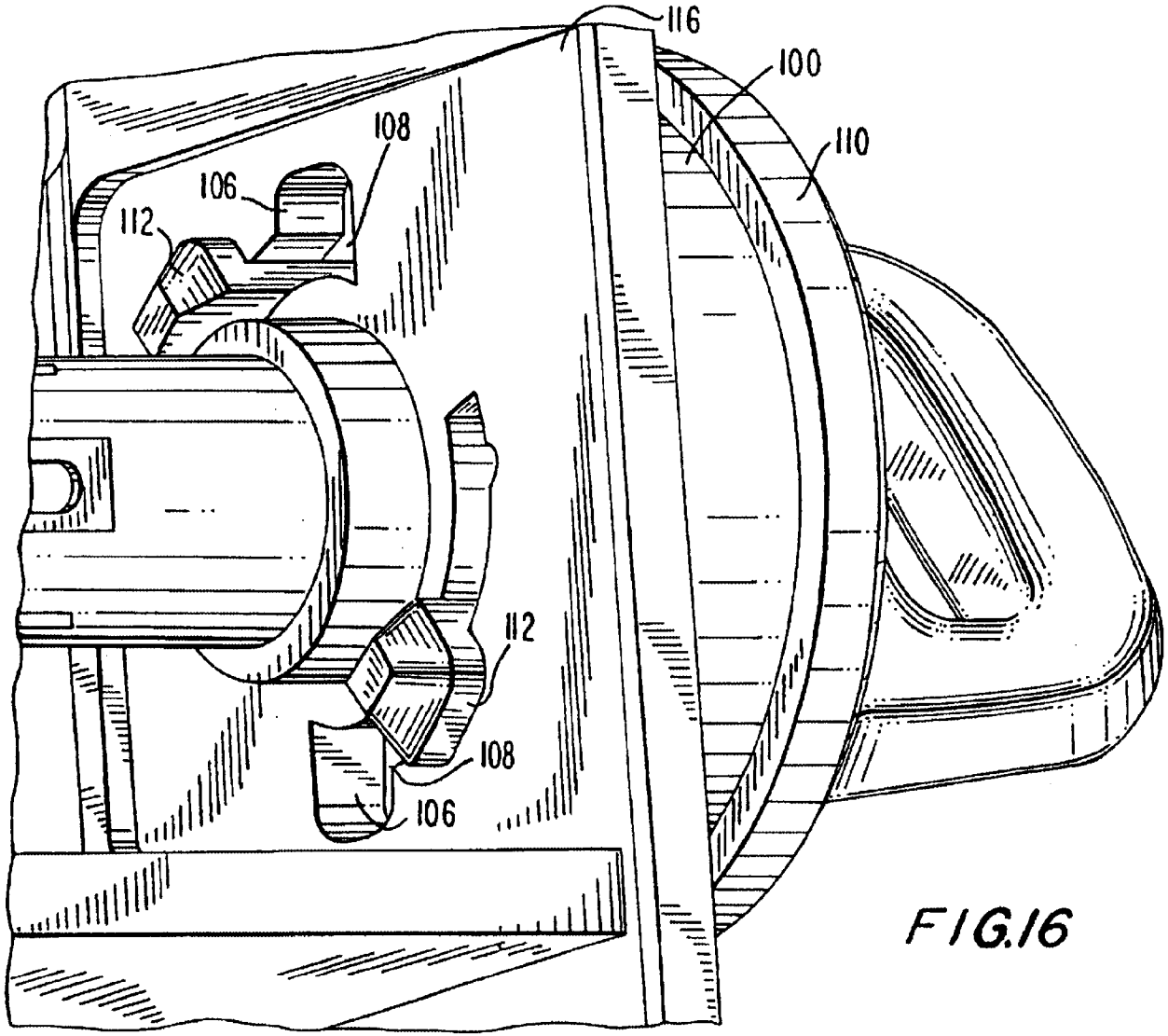
FIG. 16 is a rear side perspective view of the charging input port of FIG. 12 with a protective cover attached in a second position.
Figure 17:
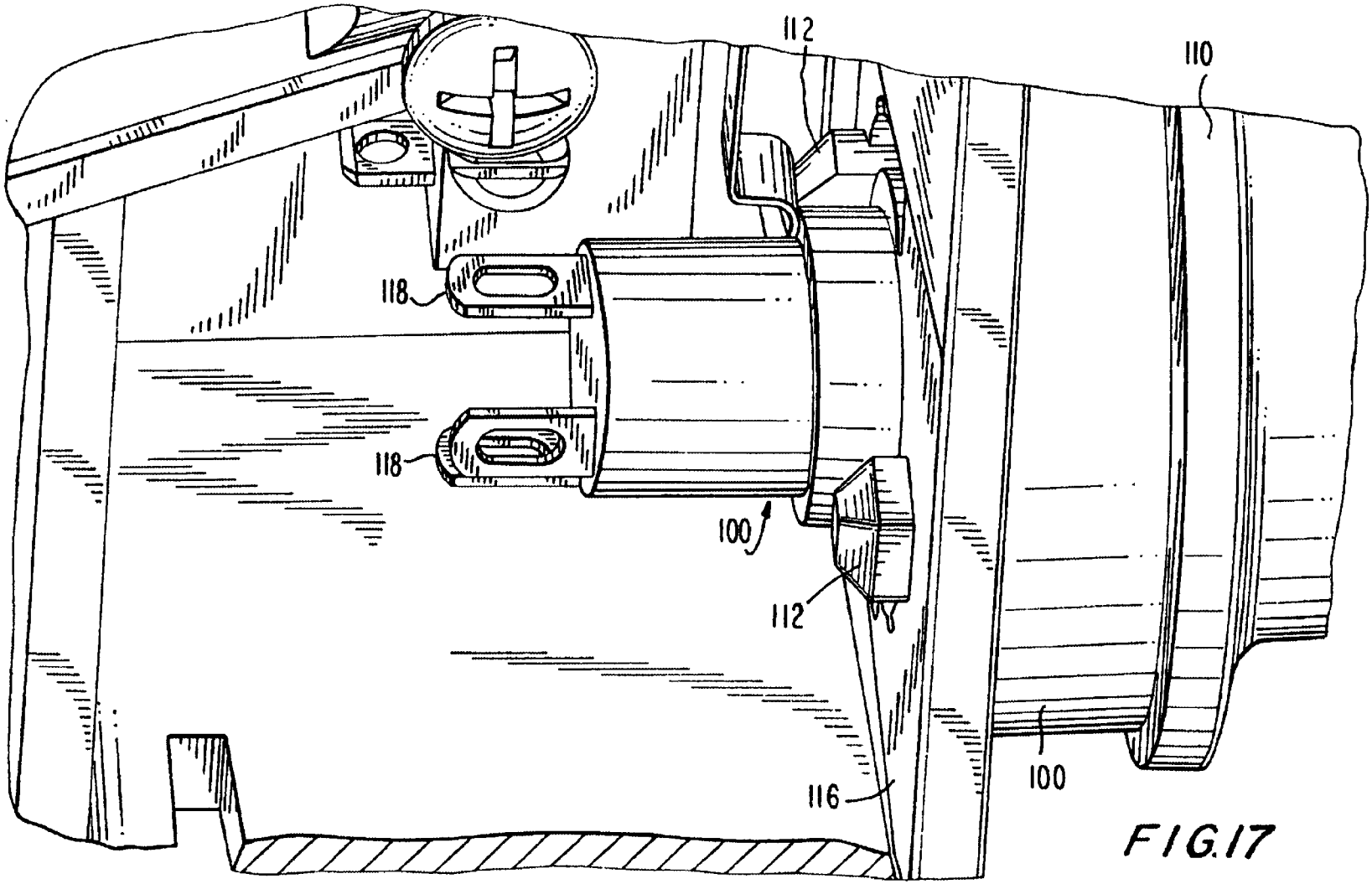
FIG. 17 is a top rear perspective view of the charging input port similar to FIG. 16.

When the protective cover 110 is initially placed into engagement with the body 16, the armatures 112 of protective cover 110 are placed in a first position in the apertures 108, as shown in FIG. 15. The apertures 108 and surfaces 106 are curved, permitting the protective cover 110 to be rotated to a second position, as shown in FIG. 16, with the armatures 112 frictionally engaging the inner surface 114 of the body 16 to provide a secure fit. Accordingly, the central metallic contact 102 shown in FIGS. 12–13 and the electrical contacts 118 from the charging input port 100 to the battery pack 84, as shown in FIG. 17, are in a water-tight setting when the protective cover 110 is secured to the charging input port 100. When the pool cleaner 10 is immersed in the pool, the central metallic contact 102 and the electrical contacts 118 are not in contact with the water and electrical shorting of the battery pack 84 is avoided.

I claim:

1. A pool cleaning kit comprising:

a hand-held submersible electrically-powered pool cleaner including:

a nozzle;

a toroidal body having:

a carrying handle for carrying, manipulating, and directing the cleaner during use, with the carrying handle being integrally formed from an upper portion of the toroidal body and an opening through the toroidal body;

a rechargeable power source;

an impeller and drive motor powered by the rechargeable power source; and a filter;

wherein the toroidal body has an intake opening in fluid communication with the nozzle; and wherein the impeller draws pool water through the nozzle and filter to remove dirt and debris from the pool water; and a charging device for charging the rechargeable power source.

2. The pool cleaning kit of claim 1, wherein the body and carrying handle of the pool cleaner are integrally molded from a high impact polymeric material.

3. The pool cleaning kit of claim 1, wherein the pool cleaner further includes:

a flexible nozzle attachment removably secured to the nozzle and attachable to the body.

4. The pool cleaning kit of claim 1, wherein body of the pool cleaner includes:

a plurality of symmetrical water discharge ports for expelling the filtered pool water from the body.

5. The pool cleaning kit of claim 1, further comprising:

a pole; and wherein the pool cleaner further includes:

a pole attachment member, mounted to the body, for retaining a free end of the pole for maneuvering the pool cleaner along a surface of the pool.

6. The pool cleaning kit of claim 1, wherein the nozzle of the pool cleaner is pivotable.

7. The pool cleaning kit of claim 1, wherein the pool cleaner further includes:

a filter housing disposed between the nozzle and the body for accumulating the filtered debris.

8. The pool cleaning kit of claim 7, wherein the filter housing includes a transparent portion.

9. The pool cleaning kit of claim 7, wherein the pool cleaner includes:

a check valve.

10. The pool cleaning kit of claim 7, wherein the filter housing of the pool cleaner is pivotally moveable with respect to the body.

11. The pool cleaning kit of claim 1, wherein the rechargeable power source includes:

at least one battery, electrically connectable to the charging device, for providing operating power to the impeller drive motor.

12. A pool cleaning kit comprising:

a hand-held submersible electrically-powered pool cleaner including;

a nozzle;

a toroidal body having;

a carrying handle for carrying, manipulating, and directing the cleaner during use, with the carrying handle being integrally formed from an upper portion of the toroidal body and an opening through the toroidal body;

a rechargeable power source;

an impeller and drive motor powered by the rechargeable power source; and a filter;

wherein the toroidal body has an intake opening in fluid communication with the nozzle; and wherein the impeller draws pool water through the nozzle and filter to remove dirt and debris from the pool water; and a charging device for charging the rechargeable power source;

wherein the rechargeable power source includes;

at least one battery, electrically connectable to the charging device, for providing operating power to the impeller drive motor, wherein the at least one battery is enclosed in an air-tight chamber within the toroidal body.

13. The pool cleaning kit of claim 12, wherein the toroidal body of the pool cleaner includes a charging port electrically connected to the at least one battery for connecting the at least one battery to the charging device providing electricity to recharge the at least one battery.

14. The pool cleaning kit of claim 13, wherein the toroidal body of the pool cleaner includes a removable cap for covering the charging port in a water-tight configuration when the pool cleaner is immersed in the pool water.

15. A pool cleaning kit comprising:

a hand-held submersible electrically-powered pool cleaner including:

a nozzle;

a body having a carrying handle, a rechargeable power source, an impeller and drive motor, and a filter, said body having an intake opening in fluid communication with the nozzle;

wherein the impeller, powered by the rechargeable power source, draws pool water through the nozzle and the filter to remove dirt and debris from the pool water;

a filter housing disposed between the nozzle and the body for accumulating the filtered debris; and a flexible nozzle attachment pivotally mounted between the nozzle and the filter housing; and a charging device for charging the rechargeable power source.

16. The pool cleaning kit of claim 15, wherein the flexible nozzle attachment is formed of a polymeric composition.

17. The pool cleaning kit of claim 15, wherein the pivoting nozzle attachment includes a yoke assembly.

18. A pool cleaning kit comprising:

a hand-held submersible electrically-powered pool cleaner including:

a nozzle;

a body having a carrying handle, a rechargeable power source, an impeller and drive motor, and a filter, said body having an intake opening in fluid communication with the nozzle;

wherein the impeller, powered by the rechargeable power source, draws pool water through the nozzle and the filter to remove dirt and debris from the pool water;

a flexible nozzle attachment removably secured to the nozzle and attachable to the body; and a generally cylindrical nozzle attachment cover having a ribbed exterior surface for attaching the nozzle to the body; and a charging device for charging the rechargeable power source.

19. The pool cleaning kit of claim 18, wherein the nozzle attachment cover includes wire reinforcement.

20. The pool cleaning kit of claim 18, wherein the nozzle attachment cover includes:

opposing terminal ends include surfaces forming water-tight seals with mating surfaces of the filter housing and the upstream end of the nozzle.

* * * * *